US011530511B2

(12) United States Patent
Yasin

(10) Patent No.: US 11,530,511 B2
(45) Date of Patent: Dec. 20, 2022

(54) GARMENT PLEATING

(71) Applicant: Petit Pli Limited, London (GB)

(72) Inventor: Ryan Yasin, London (GB)

(73) Assignee: PETIT PLI LIMITED, London (GB)

( * ) Notice: Subject to any disclaimer, the term of this patent is extended or adjusted under 35 U.S.C. 154(b) by 90 days.

(21) Appl. No.: 16/623,852

(22) PCT Filed: Jun. 20, 2018

(86) PCT No.: PCT/GB2018/051715
§ 371 (c)(1),
(2) Date: Dec. 18, 2019

(87) PCT Pub. No.: WO2018/234794
PCT Pub. Date: Dec. 27, 2018

(65) Prior Publication Data

US 2020/0332459 A1 Oct. 22, 2020

(30) Foreign Application Priority Data

Jun. 20, 2017 (GB) ..... 1709842

(51) Int. Cl.
*D06J 1/12* (2006.01)
*A41D 11/00* (2006.01)
(Continued)

(52) U.S. Cl.
CPC ..... *D06J 1/12* (2013.01); *A41D 11/00* (2013.01); *A41H 33/00* (2013.01); *D06J 1/02* (2013.01)

(58) Field of Classification Search
CPC ..... D06J 1/00; D06J 1/02; D06J 1/04; D06J 1/06; D06J 1/08; D06J 1/10; D06J 1/12; A41D 11/00; A41H 33/00
See application file for complete search history.

(56) References Cited

U.S. PATENT DOCUMENTS 2,134,630 A * 10/1938 White ..... D06J 1/12 139/421
3,823,452 A * 7/1974 Harrow ..... D06J 1/12 26/69 R (Continued)

FOREIGN PATENT DOCUMENTS

CN 1070236 A 3/1993
CN 1077173 A 10/1993

(Continued)

OTHER PUBLICATIONS

A complete guide to the most common fashion pleats blog dated Feb. 3, 2016, retrieved at http://isntthatsew.org/pleats/ by Examiner on Feb. 10, 2022 (Year: 2016).*

(Continued)

*Primary Examiner* — F Griffin Hall

(74) *Attorney, Agent, or Firm* — Fredrikson & Byron, P.A.

(57) ABSTRACT

A method of pleating a fabric, the method comprising pleating the fabric with a first pleating process to create a first set of pleats in the fabric along a first axis; pleating the fabric with a second pleating process to create a second set of pleats in the fabric along a second axis different to the first axis, wherein the second set of pleats are pleated over the first set of pleats, and wherein the first set of pleats is a set of in-plane pleats lying substantially in the plane of the fabric and the second set of pleats is a set of out-of-plane pleats which stand out of the plane of the fabric.

28 Claims, 8 Drawing Sheets

(51) Int. Cl.
*A41H 33/00* (2006.01)
*D06J 1/02* (2006.01)

(56) References Cited

U.S. PATENT DOCUMENTS

| | | | | | |
|---|---|---|---|---|---|
| 4,303,459 | A * | 12/1981 | Kleber | D06B 11/0076 | 156/227 |
| 4,725,486 | A * | 2/1988 | Corbiere | D06J 1/12 | 428/152 |
| 5,333,765 | A * | 8/1994 | Takizawa | D06J 1/12 | 26/69 R |
| 5,356,055 | A * | 10/1994 | Takizawa | D06J 1/12 | 26/69 R |
| 5,510,167 | A * | 4/1996 | Candolfi | A47C 31/11 | 428/113 |
| 6,506,219 | B2 * | 1/2003 | Kondo | A41D 27/08 | 8/114 |
| 7,669,741 | B2 * | 3/2010 | Ozaki | D03D 15/283 | 223/28 |
| 10,156,039 | B2 * | 12/2018 | Komarov | A41H 3/007 | |
| 2017/0027237 | A1 * | 2/2017 | Yu | A41B 1/18 | |
| 2017/0065005 | A1 * | 3/2017 | Nordstrom | A41D 1/02 | |

FOREIGN PATENT DOCUMENTS

| | | | | |
|---|---|---|---|---|
| DE | 2926478 | A1 | | 1/1981 |
| EP | 0924332 | A1 | * | 6/1999 |
| EP | 0924332 | A1 | | 6/1999 |
| JP | 2001049576 | A | | 2/2001 |
| JP | 2001303337 | A | | 10/2001 |
| JP | 2002115172 | A | * | 4/2002 |
| JP | 2002115172 | A | | 4/2002 |
| WO | 02097186 | A2 | | 12/2002 |

OTHER PUBLICATIONS

The world of pleats—explained! blog dated May 20, 2015, retrieved at https://byhandlondon.com/blogs/by-handlondon/26070276-the-world-of-pleats-explained, by Examiner on Feb. 10, 2022 (Year: 2015).*

Types of Pleats blog dated Mar. 13, 2012, retrieved at https://www.onlinefabricstore.com/blog/types-of-pleats/, by Examiner on Feb. 10, 2022 (Year: 2012).*

PCT International Search Report and Written Opinion dated Sep. 27, 2018 for Intl. App. No. PCT/GB2018/051715, from which the instant application is based, 9 pgs.

GB Pat. App. No. 1709842.7, Search Report under Section 17(5) dated Nov. 8, 2017, 3 pages.

* cited by examiner

GARMENT PLEATING

RELATED APPLICATIONS

This application is a 35 U.S.C. 371 national stage filing from International Application No. PCT/GB2018/051715, filed Jun. 20, 2018, which claims priority to British Application No. 1709842.7, filed Jun. 20, 2017, the teachings of which are incorporated herein by reference.

The present application relates to a method of pleating, and to garments and textiles produced via the method. The present application relates particularly, but not exclusively, to outerwear for children.

Pleating typically refers to a process of folding fabric to create fullness, ease or texture in a garment. In its most basic form, a pleat includes at least one fold line and at least one placement line. To construct a pleat a portion of fabric is typically folded along a pre-defined fold line, and the fold that is thus created is aligned with and placed onto a pre-defined placement line. The fabric may then be pressed to fix the pleat. Garments often include multiple pleats, which are often spaced equally apart.

Many different types of pleat are known in the textile industry. A common type of pleat is a flat (or knife) pleat, which is a pleat having a single fold line and a single placement line that is pressed to lie flat against the fabric or garment in which the pleat is formed. If there is more than one flat pleat formed in the fabric, all of the flat pleats usually face the same direction, and the underpleat is usually smaller than the overpleat.

An accordion pleat is a special case of a flat pleat, where the underpleat and the overpleat are the same size, such that after pressing the finished pleats stand out of the plane of the fabric or garment, making the final pleated fabric or garment resemble an accordion. Usually an accordion pleat is smaller than a flat pleat. Sometimes the term "crystal pleat" is sometimes used to refer to a small accordion pleat, e.g. having a pleat size of 2-3 mm.

When designing and manufacturing clothing for children, it is a common problem that children grow quickly, and thus regularly outgrow clothing that is otherwise still in good condition. Parents thus often have to replace clothing that is still wearable simply because it no longer fits their child. This can be both expensive and wasteful.

It is an object of the present invention to provide an alternative method construction for a garment, as well as an expandable fabric for a garment.

According to a first aspect of the invention we provide a method of pleating a fabric, the method comprising: pleating the fabric with a first pleating process to create a first set of pleats in the fabric along a first axis; pleating the fabric with a second pleating process to create a second set of pleats in the fabric along a second axis different to the first axis, wherein the second set of pleats are pleated over the first set of pleats and wherein the first set of pleats is a set of in-plane pleats lying substantially in the plane of the fabric and the second set of pleats is a set of out-of-plane pleats which stand out of the plane of the fabric. Therefore, the first set of pleats is a set of in-plane pleats lying substantially in the plane of the fabric after the first pleating process and the second set of pleats is a set of out-of-plane pleats which stand out of the plane of the fabric after the second pleating process.

A fabric pleated in line with the above method has a substantially auxetic behaviour. That is, when such a fabric is subjected to a tensile stress (e.g. stretched) along the first axis, it will also undergo an expansion along the second axis.

This behaviour is in contrast to most conventional fabrics, which typically undergo a contraction along a second axis when stretched along a first axis. Furthermore, the combination of a first set of in-plane pleats (i.e. a type of pleat that lies in the plane of the fabric after being formed or pressed) along a first axis and a second set of out-of-plane pleats (i.e. a type of pleat that stands up from the plane of the fabric after being formed or pressed) along a second axis enables the fabric to expand smoothly and reliably along both axes, thereby enhancing the controllability and predictability of the auxetic behaviour of the fabric.

A material pleated in accordance to the above method is useful for clothing, particularly children's clothing, as a garment that is made from such a fabric will expand simultaneously in two directions, and so is advantageously able to accommodate the growth of the wearer and facilitate the dressing of the wearer. Further, the combination of a first set of in-plane pleats along a first axis and a second set of out-of-plane pleats along a second axis enables the garment to achieve an optimal balance between aesthetics and technical performance, so that the garment is both aesthetically appealing and adaptable to the growth of a particular wearer.

The material pleated in accordance to the above method is not exclusively for use in garments and may be also used in any form of expandable or deployable equipment such as storage equipment, backpacks, luggage, tents, dynamic roofing, emergency shelters or stretchers. The pleated material in accordance to the above method allows for ease of packing and storage for later use as well as the ease of transportation from one location to another, all of which enable the pleated material to be used in a wide range of applications and not only in garments.

The first set of pleats and the second set of pleats preferably comprise continuous pleats.

The first set of pleats and the second set of pleats preferably extend over substantially the entire fabric.

The garment may be steamed after each pleating process to fix the pleats. Each steaming process may take up to 40 minutes, for instance 20, 25, 28 or 30 minutes. Steaming may not be necessary, especially with some fabrics, such as synthetic fabrics, for which the pleating process is permanent. Steaming for too long may damage the fabric.

The second axis is preferably 75-90 degrees to the first axis, for example 80-90 degrees, or 85-90 degrees. Most preferably the second axis is substantially orthogonal to the first axis (i.e. 90 degrees to the first axis). This helps to ensure the fabric grows linearly along the second axis as it is stretched along the first axis.

The first set of pleats is a set of in-plane pleats. The first set of pleats may comprise a single type of in-plane pleat or a combination of different types of in-plane pleats. Preferably, the first set of pleats is a set of equally spaced flat pleats. Each flat pleat preferably has an overpleat depth less than 15 mm, for instance 2 or 3-15 mm, 5-12 mm, and preferably 7-10 mm. The underpleat depth may be less than the overpleat depth, for example less than 12 mm, such as 2 or 3-10 mm, 7-10 mm, and preferably 7 mm. Alternatively, the underpleat depth may be the same as or larger than the overpleat depth. Constructing the first set of pleats as flat pleats conveniently allows the fabric to be pleated a second time, because flat pleats lie in the plane of the fabric.

The second set of pleats is a set of out-of-plane pleats. The second set of pleats may comprise a single type of out-of-plane pleat or a combination of different types of out-of-plane pleats. Preferably, the second set of pleats is a set of equally spaced accordion pleats. Each accordion pleat may have a depth of 5-10 mm, and preferably between 7-10 mm.

The first and second sets of pleats may comprise pleats that are not equally spaced. The spacing between consecutive pleats may vary throughout the fabric or garment and/or may alternate between different spacing values. The spacing between consecutive pleats may follow a pattern or sequence of different spacing values.

The inventor has found that this specific combination of flat and accordion pleat types most reliably produces an auxetic structure in the widest range of fabric types and fabric thicknesses. Furthermore, out of the type of pleats mentioned below, the combination of flat and accordion pleats guarantees an optimal deformation or expansion performance for a wide range of fabric types and fabric thicknesses. The inventor also found that garments made from such a fabric are more likely to reliably return to its original undeformed state with minimal wrinkles or creases than garments made with fabrics having different combinations of pleats. The build-up of wrinkles or creases can negatively affect the reliability of the expansion properties of the pleated fabric. Additionally, the combination of flat and accordion pleat types provides a structure resembling a tiled roof. Such a 'tiled-roof' structure directs fluid or solid particles off the outer surface of the garment or fabric and prevents the fluid or solid particles from being trapped and accumulating within the pleats, thereby improving the weatherability of the fabric or garment. The structure provided by the combination of flat and accordion pleat types also provides the fabric or garment with symmetrical and consistent properties throughout the material. This means that, for example, the weatherability or aerodynamic properties of the fabric or garment are the same on both sides of the garment and throughout the pleated material.

However, it is also possible for the second set of pleats to comprise pleats such as flat (or knife) pleats, box pleats, inverted pleats, sunray (or sunburst) pleats or crystal pleats. It is also possible for the first set of pleats to comprise pleats such as box pleats, inverted pleats, crystal pleats, accordion pleats or sunray (or sunburst) pleats. It is preferred that a pleat which lies in the plane of the fabric when pressed is used for the first pleat, for instance box pleats or inverted pleats, as using a first pleat which lies flat means that the second pleating process can be applied without damaging the appearance of the first set of pleats. Furthermore, other types of flat-lying pleat than knife pleats typically result in a bulkier fabric once the second pleating process has been applied, thus knife pleats are preferred.

The depth of the second pleats may be less than the depth of the first pleats, such that the fabric expands more along the first axis than along the second axis.

The method may further comprise the step of forming one or more holes in an underpleat of at least one pleat in the first set of pleats. The hole or holes may be formed by punching or cutting, e.g. laser cutting. The fabric may be pleated prior to forming the holes, and the pleats stretched apart so that the holes can be formed in the underpleats. Preferably a plurality of holes is formed in the underpleat of the first set of pleats at equally spaced intervals, e.g. one for every three, two or one of the second set of pleats.

Forming holes in the underpleat conveniently provides ventilation to the fabric. Such a fabric can be used for rainwear, as the ventilation holes are concealed in the underpleat such that rain is diverted away from the hole by the overpleat.

Preferably the fabric comprises a garment, and preferably the first and second pleating processes are applied to the garment. The pleating may be applied after the garment has been fully sewn, but before any fastenings or trimmings have been added to the garment. The garment may be a single layer garment, or may be a multi-layer garment, for instance a garment including a lining.

Where the garment comprises sleeves, prior to the first pleating process, the method may further comprise the step of folding the sleeves at an elbow region such that a sleeve axis extends substantially parallel to the first garment axis, with a wrist portion of the sleeve towards a lower edge of the garment. The sleeve fold is preferably kept the same for both the first and second pleating processes. This helps improve the movement of the sleeve when the garment is worn, and helps to ensure that each sleeve grows along its axis at the same rate that the body of the garment grows along its axis.

Where the method is applied to a sewn garment, the first axis is preferably selected to be substantially vertical when the garment is worn, and the second axis is preferably selected to be substantially horizontal when the garment is worn. This results in a consistent expansion along the length and width of the garment as the wearer grows.

Preferably the fabric is a synthetic fabric, as synthetic fabrics tend to retain pleats better than natural fibres. Most preferably the fabric is PU (polyurethane) coated nylon or polyester. Alternatively, the fabric may be a synthetic/natural fibre blend, such as polycotton. If the fabric is to be sewn into a garment prior to pleating, the fabric is preferably thin, and may have a weight of less than 4 oz per square yard (about 140 grams per square meter or gsm), and preferably has a weight of approximately 2 oz per square yard (about 70 gsm). Alternatively, if the fabric is to be pleated prior to sewing, the fabric may have a weight of up to 12 oz per square yard (about 410 gsm), e.g. 5-10 oz per square yard (about 170-340 gsm), or 8-10 oz per square yard (about 270-340 gsm).

According to a second aspect of the invention there is provided a method of constructing a garment, wherein the method comprises sewing a fabric into a first garment layer, and pleating the first garment layer; sewing a second fabric into a second garment layer of substantially the same size and shape to the first garment layer, so as to provide a lining to the first garment layer, and pleating the second garment layer; and sewing the first garment layer to the second garment layer, wherein both garment layers are pleated in accordance with the method of the first aspect of the invention. The second garment layer is preferably pleated with the same pleat structure (i.e. size of pleat, type of pleat, and layout of pleats) as the first garment layer in order to ensure that both garment layers expand in the same manner when the garment is worn. However, the second garment layer could be pleated with a different pleat structure (i.e. size of pleat, type of pleat, and layout of pleats) to that of the first garment layer.

Insulation may be inserted between the first and second garment layers. An insulated and expandable outerwear garment can thus be conveniently produced via this method.

According to a third aspect of the invention, a fabric is provided comprising a first set of pleats along a first axis and a second set of pleats along a second axis different to the first axis, wherein the second set of pleats are pleated over the first set of pleats and wherein the first set of pleats is a set of in-plane pleats lying substantially in the plane of the fabric and the second set of pleats is a set of out-of-plane pleats which stand out of the plane of the fabric. The fabric may be pleated according to the method of the first aspect of the invention. Therefore, the first set of pleats is a set of in-plane pleats lying substantially in the plane of the fabric after the first pleating process and the second set of pleats is a set of out-of-plane pleats which stand out of the plane of the fabric after the second pleating process.

According to a fourth aspect of the invention, a garment is provided comprising a first set of pleats along a first axis and a second set of pleats along a second axis different to the first axis, wherein the second set of pleats are pleated over the first set of pleats and wherein the first set of pleats is a set of in-plane pleats lying substantially in the plane of the garment and the second set of pleats is a set of out-of-plane pleats which stand out of the plane of the garment. The garment may be pleated according to the method of the first aspect of the invention. Therefore, the first set of pleats is a set of in-plane pleats lying substantially in the plane of the garment after the first pleating process and the second set of pleats is a set of out-of-plane pleats which stand out of the plane of the garment after the second pleating process.

The first set of pleats and the second set of pleats preferably extend over substantially the entire fabric or garment.

The second axis is preferably 75-90 degrees to the first axis, for example 80-90 degrees, or 85-90 degrees. Most preferably the second axis is substantially orthogonal to the first axis (i.e. 90 degrees to the first axis).

The first set of pleats is preferably a set of equally spaced flat pleats. Each flat pleat preferably has an overpleat depth of less than 15 mm, 5-12 mm, for instance 7-10 mm. The underpleat depth may be less than the overpleat depth, for example less than 12 mm, 7-10 mm, and preferably 7 mm. It is also possible for the first set of pleats to be crystal pleats, or another type of flat-lying pleat such as box pleats.

The second set of pleats is preferably a set of equally spaced accordion pleats. Each accordion pleat may have a depth of 5-10 mm, and preferably between 7-10 mm. It is also possible for the second set of pleats to be flat pleats or crystal pleats.

The depth of the second set of pleats may be less than the depth of the first set of pleats.

At least one pleat in the first set of pleats may comprise one or more holes formed in an underpleat. Preferably a plurality of holes is formed in the underpleat of the first set of pleats at equally spaced intervals, e.g. one for every three, two or one of the second set of pleats.

The garment may comprise a first garment layer and a second garment layer of substantially the same size and shape to the first garment layer so as to provide a lining to the first garment layer, and insulation between the two layers, wherein each garment layer is pleated in accordance with the method of first aspect of the invention.

It will be appreciated that the various features of the above aspects of the invention may be combined together in any appropriate combination in use, as desired by the skilled person.

The invention will now be described in more detail, by way of example only, with reference to the accompanying drawings in which.

Figure 1:
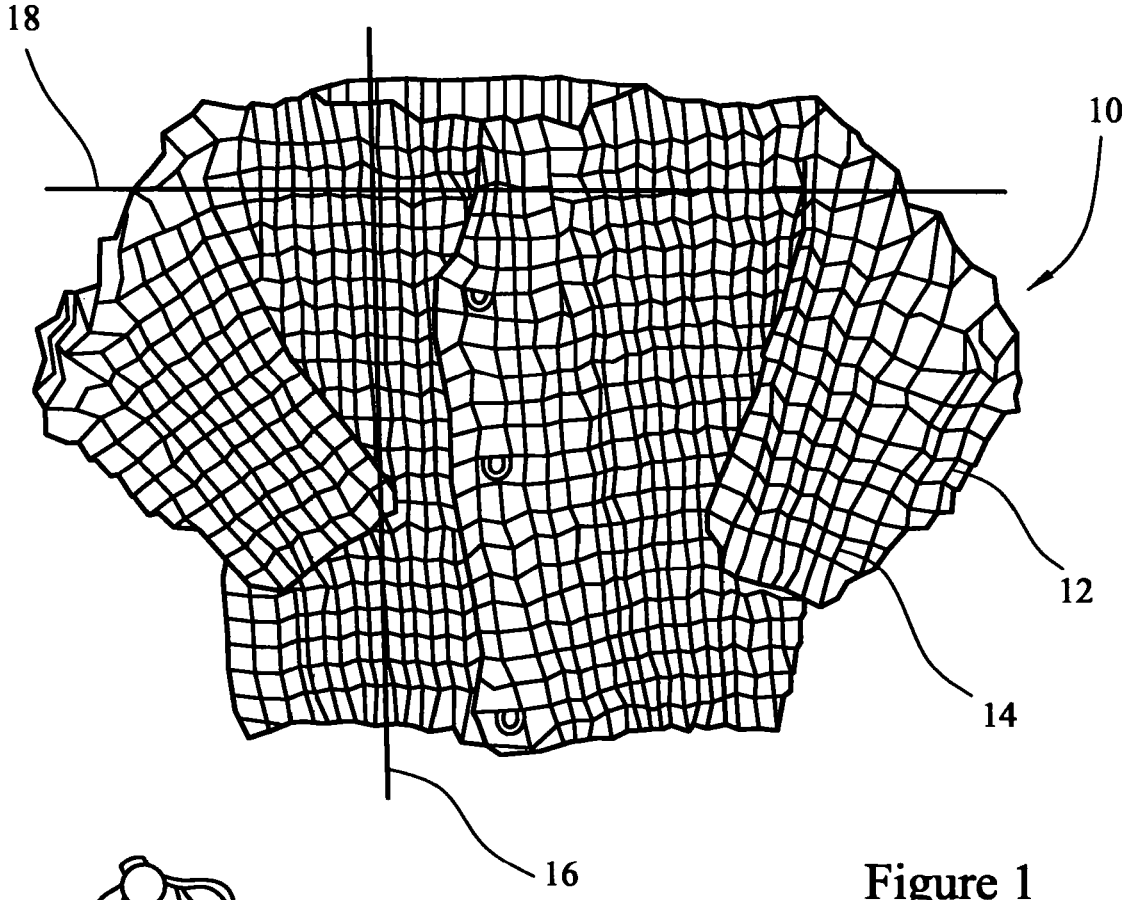
FIG. 1 shows a pleated child's jacket.
Figure 5:
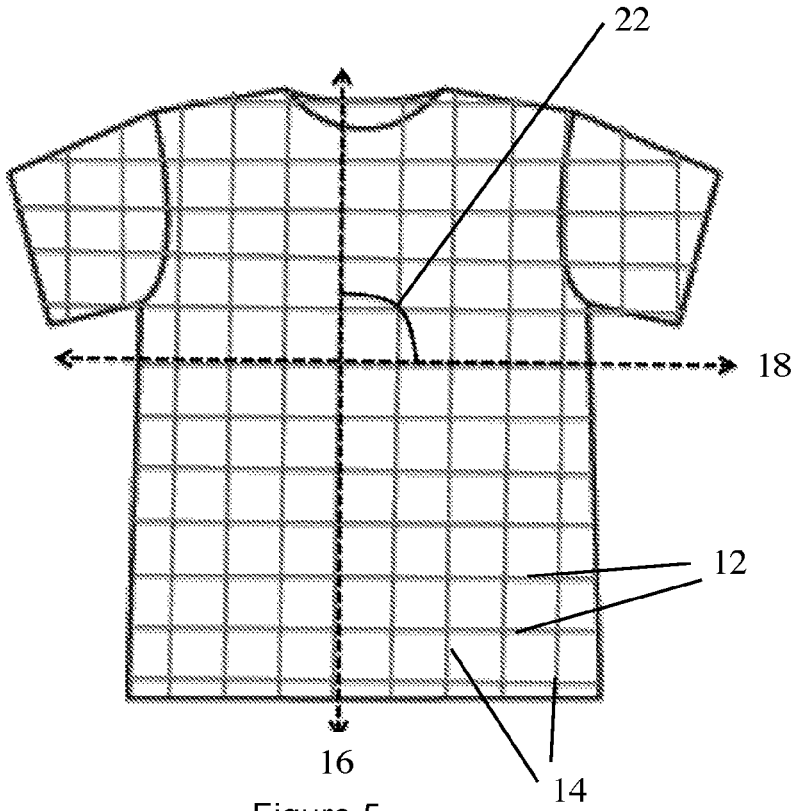
FIG. 5 illustrates the placement of a first set of pleats and a second set of pleats.

Referring to FIGS. 1 and 5, a garment 10 comprises a first set of pleats 12 and a second set of pleats 14. The first pleats 12 are folded into the garment along (i.e. orthogonal to) a first axis 16. The second pleats are folded into the garment along (i.e. orthogonal to) a second axis 18 different to the first axis. The second set of pleats 14 is pleated over the first set of pleats 12 to produce a double pleated structure. Each pleating process is, in the example sewn, applied to a whole garment after it is sewn, such that in each pleating process both sides of the garment are pleated at the same time and in the same pattern.

The locations of the first and second axes are selected to dictate the desired directions of garment expansion when the garment is in use. In the examples shown, the first axis 16 is selected to be substantially vertical when the garment is worn, and the second axis 18 is selected to be substantially horizontal when the garment is worn. This ensures that the main directions of growth are vertical and horizontal, which mimics the typical growth of a wearer, and helps the garment maintain its overall shape as it expands.

As shown best in FIG. 5, the second axis is at an angle 22 to the first axis. In the examples shown, the angle is approximately 90 degrees (i.e. orthogonal). Pleating the garment along two orthogonal axes again helps the garment to maintain its overall shape as the garment grows with the wearer.

Figure 3:
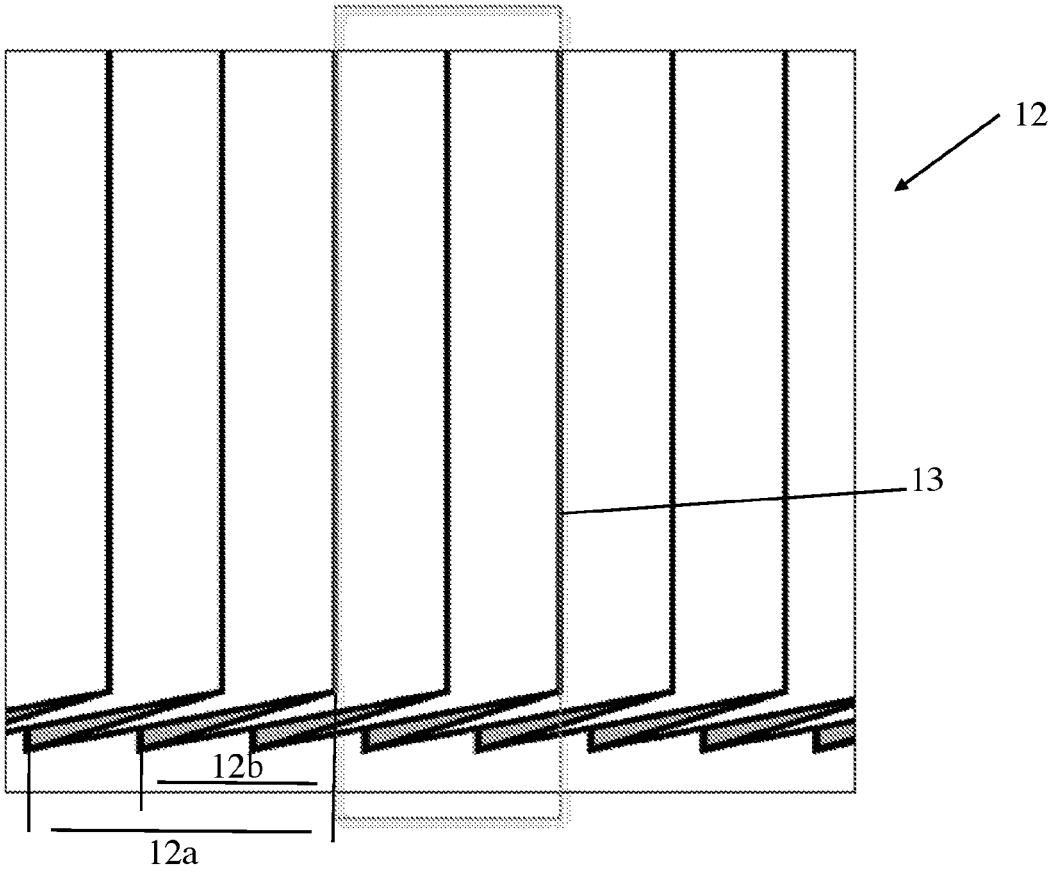
FIG. 3 illustrates a first exemplary pleat construction.

Referring now to FIG. 3, a garment segment including an exemplary first set of pleats 12 is shown in more detail. The illustrated first pleats 12 are flat pleats (also known as knife pleats). Each pleat has an overpleat depth 12*a* and an underpleat depth 12*b*. The overpleat depth is defined, in this case, as being the distance between each fold line 13 when the pleats are pressed and lying flat, i.e. the distance between the leading edge of each pleat. The underpleat depth is, in this case, is how far each pleat folds back on itself (i.e. half the distance between a fold line and its respective placement line before the fabric is pleated). In the example shown the overpleat depth is between 5 and 12 mm, in this case approximately 10 mm, whilst the underpleat depth is between 7 and 10 mm, in this case approximately 7 mm. When folded into the fabric the flat pleats lie flat against the surface of the fabric (i.e. in-plane pleats).

Figure 4:
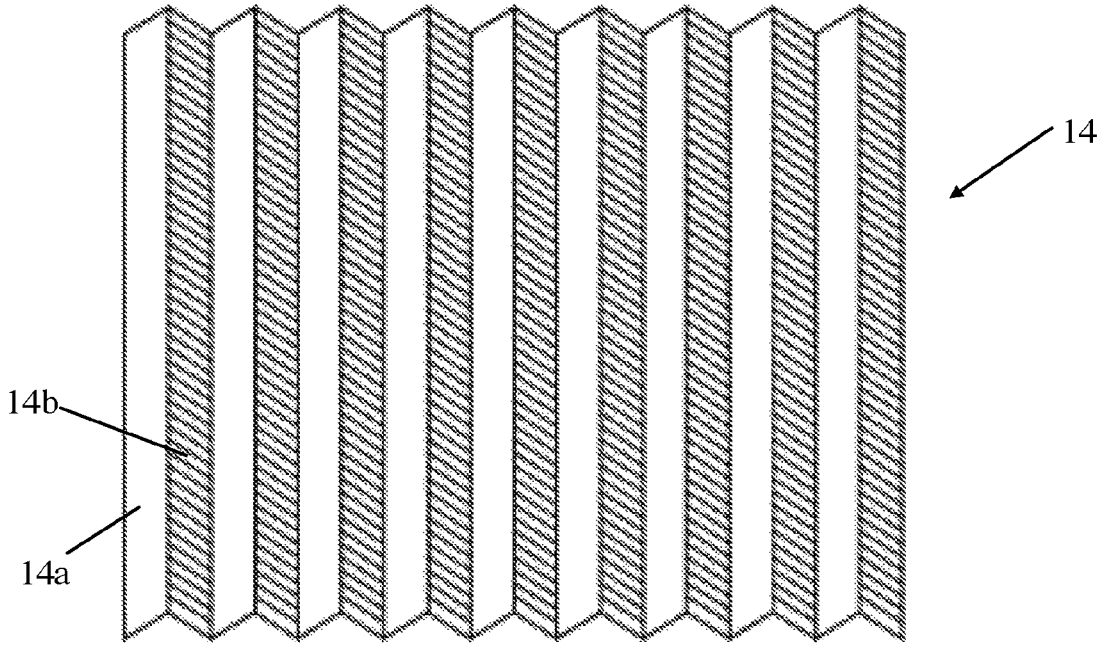
FIG. 4 illustrates a second exemplary pleat construction.

FIG. 4 shows a garment segment including an exemplary set of second pleats 14. For clarity, the second set of pleats in FIG. 4 is shown in isolation, rather than pleated over a first set of pleats. The illustrated second pleats 14 are accordion pleats. Again, each pleat has an overpleat depth 14*a* and an underpleat depth 14*b*, which in this case are substantially identical to each other, and are defined as being the distance between a fold line and its respective placement line, so as to produce a set of pleats that stand up from the fabric in a three dimensional manner (i.e. out-of-plane pleats). The pleat depth is in this example between 7 and 10 mm, for example 7 mm.

Figure 2:
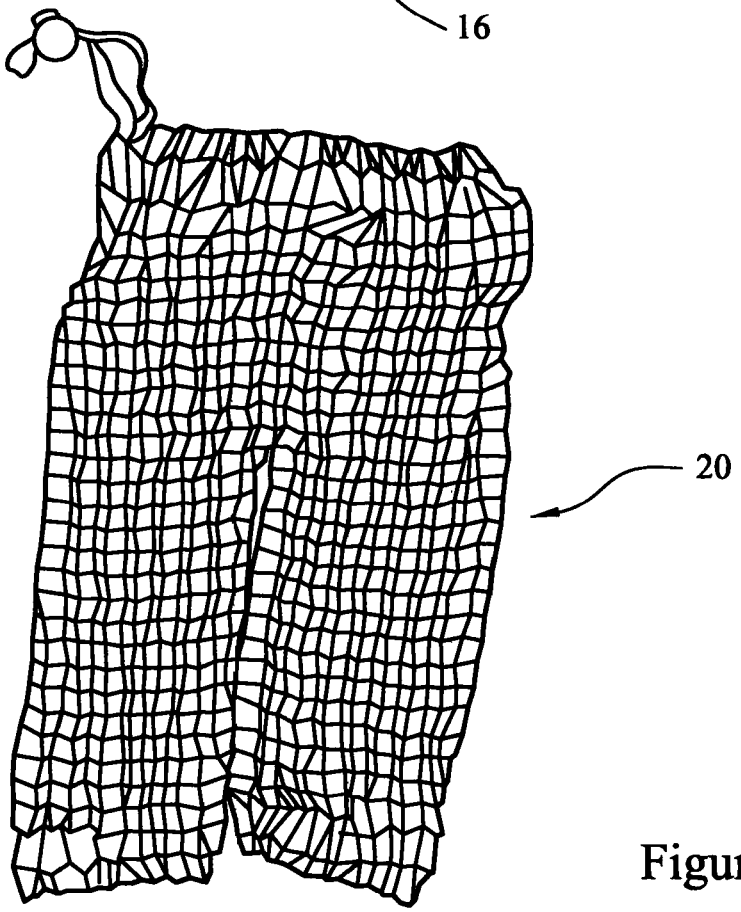
FIG. 2 shows a pair of pleated child's trousers.

The garment 10 shown in FIG. 1 is a jacket for a child. An alternative example of a garment 20 is shown in FIG. 2, which illustrates a pair of trousers for a child. In both cases, the garment is sewn first, and then the first and second pleating processes applied to the substantially finished garment. Any necessary fastenings or trimmings such as buttons, zips, elastic, stirrups, ribbons or cords are applied later so as not to interfere with the pleating processes. Alternatively, any necessary fastenings or trimmings such as buttons, zips, elastic, stirrups, ribbons or cords can be applied before or in between the pleating processes.

An exemplary pleating process is schematically illustrated in FIGS. 6-9. As outlined in FIG. 6, a method of pleating a fabric comprises: first, pleating the fabric with a first pleating process to create a first set of pleats in the fabric along a first axis; and then second, pleating the fabric with a second pleating process to create a second set of pleats in the fabric along a second axis different to the first axis, wherein the second set of pleats are pleated over the first set of pleats.

Figure 7:
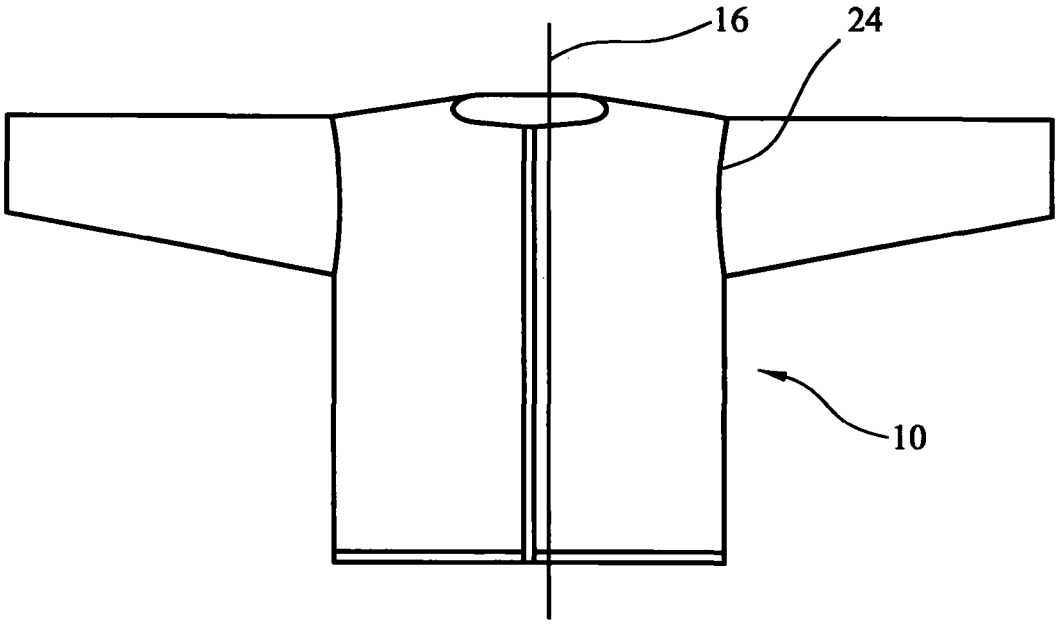
FIG. 7 shows an unpleated sewn garment.

When pleating a garment, rather than a fabric, it is preferable to first sew the garment into the desired shape, as shown in FIG. 7. A thin fabric is preferred, as after pleating the garment will be folded into four layers ("4 ply") in some spots, and may be up to 12 ply at the seams.

By "thin" we mean preferably in the order of 2 oz per square yard (about 70 gsm) by weight. In the example shown the garment is made from a synthetic fabric, such as polyester or PU coated nylon. Synthetic fabrics are suitable for pleating because they can be made to permanently deform during the pleating process, ensuring they hold the pleats well. Any wearable material which exhibits similar behaviour when pleated can be used as an alternative fabric if required. For instance, synthetic/natural fabric hybrids such as polycottons can pleat well too. Such hybrid fabrics may also be suitable for innerwear.

An advantage of making a garment by sewing first and then pleating, is that pleating the fabric(s) first and then sewing the pleated fabric(s) into a garment after pleating can be tricky. The fabric must be held in an expanded state in order to sew the garment pieces together, and this can result in bowing at the seams (if, for instance, the pleats of the sleeve do not align with the pleats on the torso section). Thus although it is possible to pleat a fabric first and then sew a garment afterwards, in many circumstances sewing the garment first and then pleating afterwards is more efficient as it simplifies the process and removes the need to align the pleats.

Figure 8:
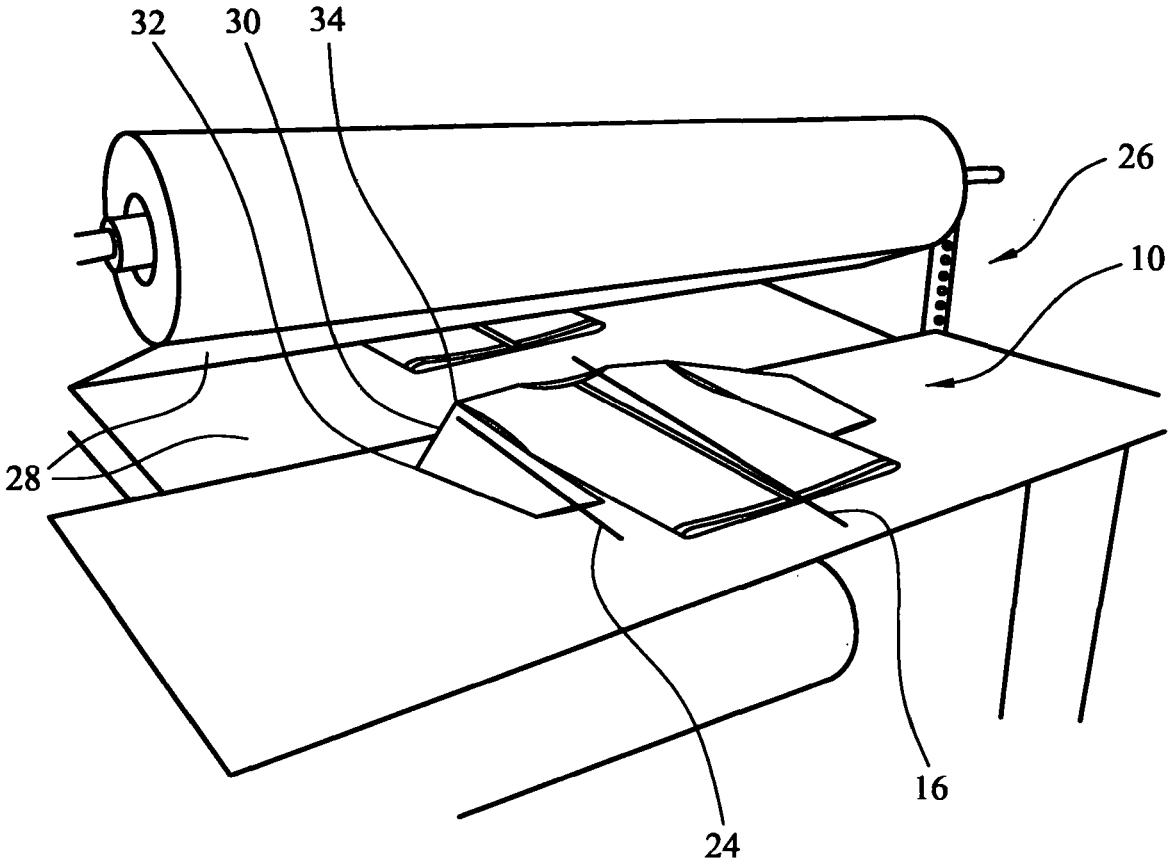
FIG. 8 shows the garment of FIG. 7 folded ready for a first pleating process.
Figure 9:
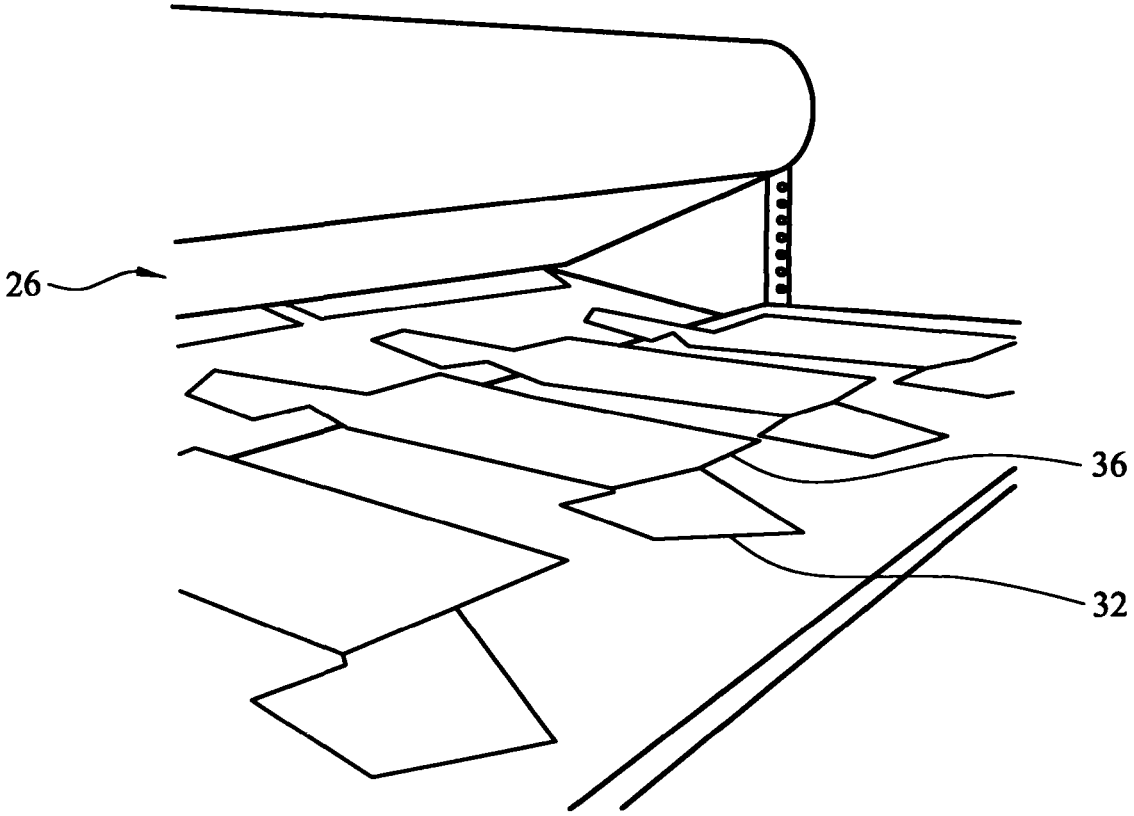
FIG. 9 shows a once-pleated garment folded ready for a second pleating process.

After sewing the garment is ready for the first pleating step of the method. Where the garment has sleeves, as shown in FIG. 8, it is preferred that the sleeves are folded 30 at an elbow region 32, such that a longitudinal axis 24 of the sleeve lies substantially parallel to the vertical axis of the garment (which in this case coincides with the first pleating axis 16). As illustrated in FIG. 8, the fold 30 may extend from the elbow region 32 of the sleeve to a shoulder region 34 of the sleeve. Alternatively, as shown in FIG. 9, the fold 30 may extend from the elbow region 32 of the sleeve to an underarm region 36 of the sleeve. Whichever type of fold 30 is made in the sleeve, it should preferably be maintained in the same fold configuration for both the first and second pleating processes.

When the garment has been folded as desired, the first set of pleats 12, in this case flat pleats, are folded into the garment down the vertical axis of the garment. The pleats are most efficiently applied using a commercial pleating machine 26. The garment is fed flat into the machine after sewing (and, if required, folding) such that the first pleating axis 16 is parallel to a feed direction of the machine 26. This ensures that the first pleats are applied into the garment perpendicular to the first pleating axis. The pleating machine shown in FIGS. 8 and 9 is a standard commercial pleating machine, which sandwiches a garment to be pleated between two sheets of pleating paper 28 and applies heat to the fabric during pleating to assist in fixing the pleats. In the process used in the present example, the machine is operated at a slow frequency—about 1 row per second—which helps ensure the garment is fed in well, and heat is applied for longer duration. The temperature used is typically in the range 130-180 degrees C., and in this example is about 140 degrees C.

It is preferred that the first pleats are inserted into the fabric such that the fold line 13 of each pleat points towards the bottom of the garment when the garment is worn. This helps prevent the underpleat fold from trapping unwanted substances such as dirt or rainwater when the garment is worn. With this in mind, in the pleating machine shown in FIG. 8, the end of the garment which will be the top of the garment in use is fed into the pleating machine first, so that the folds 13 of the first set of pleats are directed away from the top of the garment.

After the first pleating process is complete, the garment may be removed from the pleating machine 26 and steamed between the sheets of pleating paper to fix the first set of pleats 12 into the garment. In the example shown, heat and/or steam is applied for approximately 30 minutes. However it will be appreciated that the duration of the steaming will depend to some extent on the type of fabric which is used for the garment—some fabrics will require more or less heat and/or steam to fix the pleats.

After the first pleats are fixed, the garment is then fed back into the pleating machine (or a different pleating machine) to apply the second set of pleats 14. Prior to the second pleating step, the garment is rotated through an angle 22 (ideally 90 degrees) until the second pleating axis is substantially parallel with the feed direction of the pleating machine. This ensures that the second set of pleats is applied at an angle 22 to the first set of pleats, in order to produce the desired expandable structure.

After the second pleating process the garment is again heated and/or steamed (in this case again for 30 minutes) to fix the second set of pleats in place.

As outlined above, the first set of pleats is ideally made up of flat pleats. Forming the first set of pleats as flat pleats is preferable because this type of pleats lies flat against the garment, so permitting a second pleating process to be applied over the top.

In the exemplary process discussed above the second set of pleats is ideally made up of accordion pleats. These pleats are typically smaller than flat pleats. With this combination of pleats we have found it desirable that the flat pleats are applied along the vertical axis of the garment, whilst the accordion pleats are applied along the horizontal axis. If the overpleat depth of the flat pleat is selected to be larger than the depth of the accordion pleats, this means that the garment will expand more along its length (i.e. in line with the vertical axis) than along its width (i.e. in line with the horizontal axis) when it is worn, which mimics the typical growth of a child. If desired, the amount of expansion in the garment can be controlled by selecting the ratio of the depth of the first pleats to the depth of the second pleats. That is, the deeper the pleats along are one axis than the pleats along the other axis, then the more the garment will expand along a respective pleating axis.

A garment made according to the process described above has many properties which make it advantageous for use as outerwear, particularly outerwear for children. For instance, a garment made according to the method described herein is extremely portable, as it can shrink to a small size for storage and expand to a larger size for wear. One garment can fit a wide range of wearers, meaning stores can, if they wish, stock fewer garments and still fulfil the range of sizes demanded by their customers.

Figure 10:
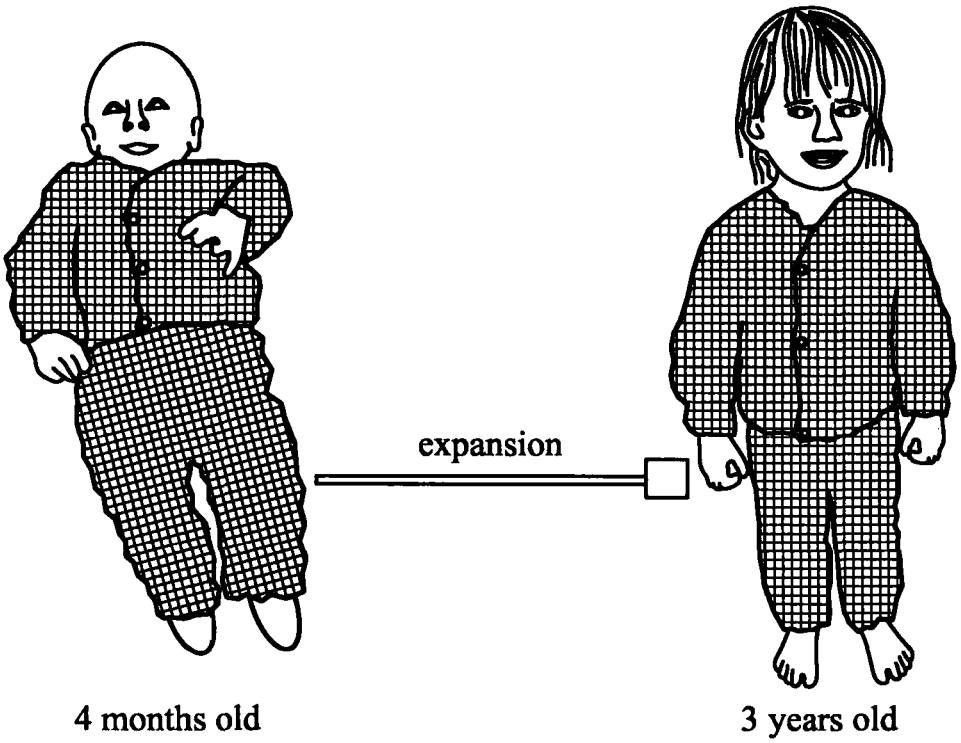
FIG. 10 illustrates pleated garments (a) worn by a four month old baby, and (b) by a three year old child.

A garment made according to the methods described herein is extremely expandable, making dressing a child easier for both the child and parent, and more comfortable for the child. Once on, the garment contracts to comfortably fit the dimensions of the child and expands to permit a wide range of motion. FIG. 10 illustrates the large expansion possible—the same garments are shown worn by a 4 month old baby and a 3 year old child. Garments made according to the process described herein are thus versatile, long lasting, and cost effective, and hence more environmentally friendly.

So long as the selected fabric holds pleats well (e.g. a synthetic fabric), the garment can be washed repeatedly and will maintain its auxetic properties after washing, including machine washing (cold/30 degrees is recommended).

When pleating a presewn garment, as described above, it is desirable for the fabric to be thin, as when the fabric is fed into the pleating machine 26 for the first pleating operation it is double thickness, or more at the seams, which can be up to 4 ply, plus thread thickness. Alternatively, the fabric can be pleated prior to construction of a garment, and then formed into a garment at a later time, or can be used as segments of a garment for added benefits such as increased mobility or ventilation panels (especially on sportswear). This might be desirable, for example, if manufacturing rainwear. Such items are typically formed from waterproof material, such as 50% Polyester, 50% Polyurethane (PU); GoreTex™; 100% Polyester; 100% nylon. These materials typically have restricted breathability, making them hot and uncomfortable to wear in some situations. Some can also reach a saturation point at which they lose effectiveness.

Figure 6:
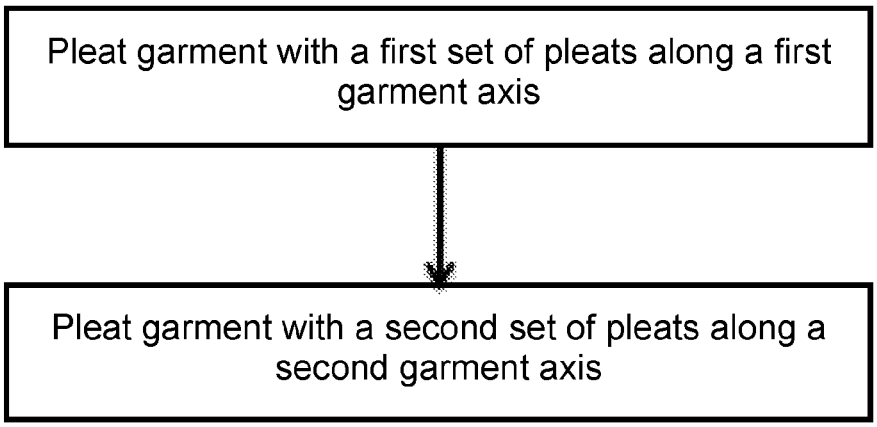
FIG. 6 shows an exemplary method of pleating.
Figure 11:
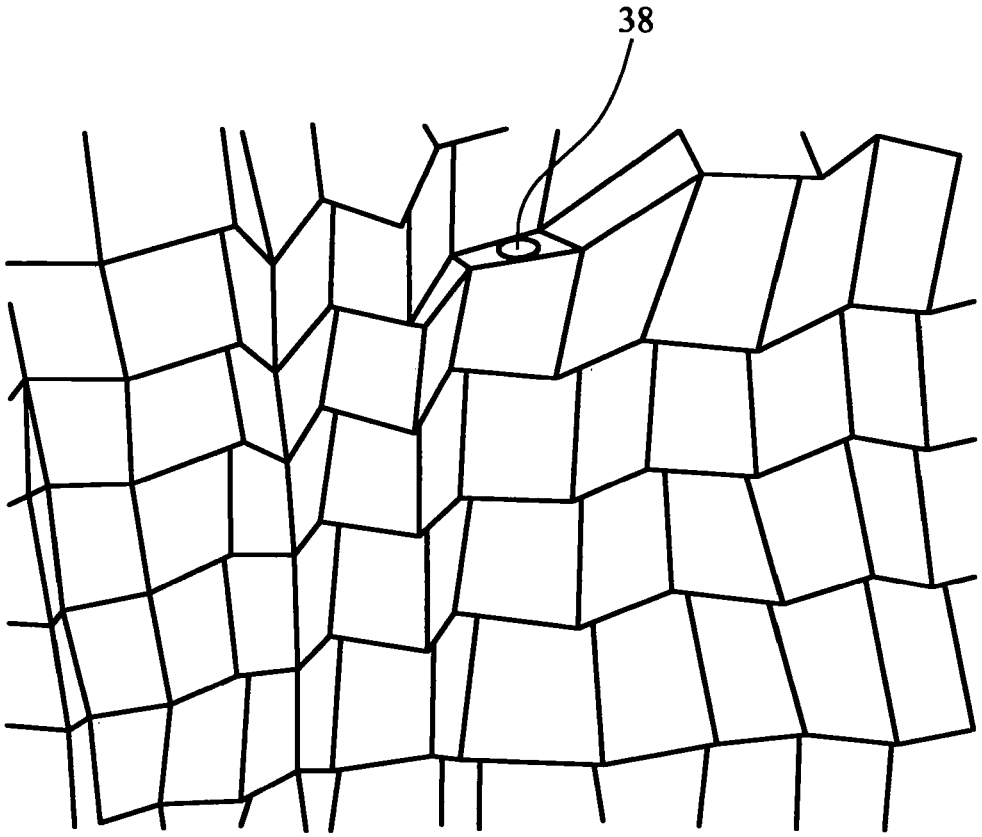
FIG. 11 shows a pleated fabric including ventilation holes.
Figure 12:
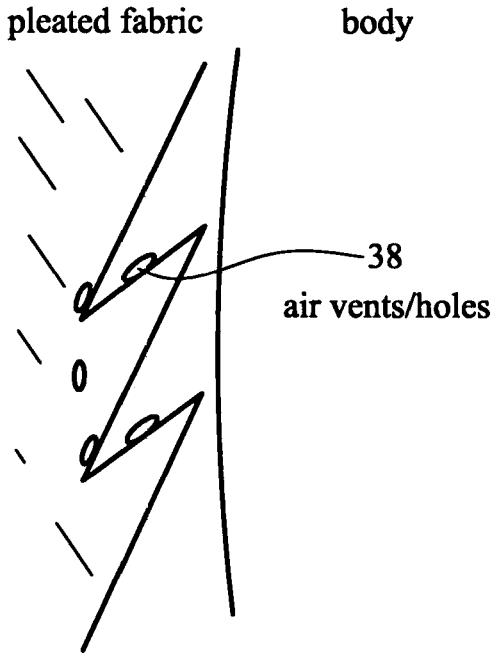
FIG. 12 is a schematic cross sectional view of a fabric similar to that shown in FIG. 11.
Figure 13:
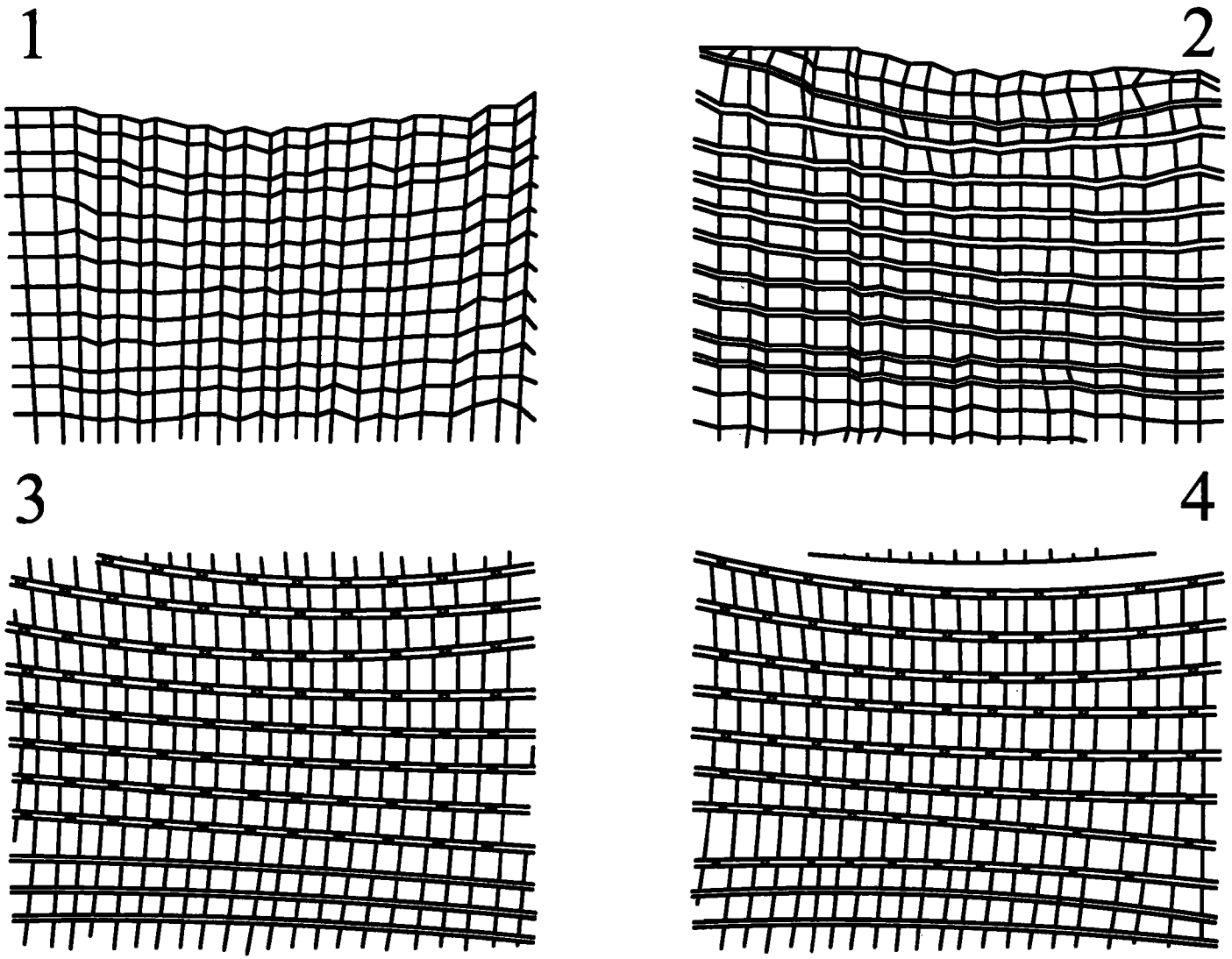
FIG. 13 shows the ventilated pleated fabric of FIG. 12 in more detail.

A fabric pleated according to the method of FIG. 6 can conveniently be provided with one or more ventilation holes 38 under the first pleats, as shown in FIGS. 11-13. The ventilation holes can prove more effective at providing ventilation than conventional breathable materials due to their size, and can be more cost effective than many breathable materials, which can be expensive.

The holes can either be formed in the fabric prior to the pleating processes, or can be formed after pleating, by stretching the pleats apart until the fabric is flat. Forming the holes after pleating may result in a more accurate hole placement. The holes may be formed by punching or laser cutting. Preferably the holes are formed in the fabric in a grid layout, with each hole located in an area of the fabric which will form part of an underpleat of the first set of pleats when the fabric is fully pleated. Preferably the holes are not positioned on the creases/bends of the pleated material; but between them (in order to maintain structural rigidity from the pleating process). The diameter of the holes may depend, to some extent, on the size of the pleats, as it is desirable for the holes to be completely covered by the overpleat when the pleats are flat, so as to avoid rain ingress. Typically the holes may be 1-3 mm in diameter.

When the garment is in use, typically the pleats do not lie completely flat against the wearer's body, but rather open up slightly, allowing air to pass through the ventilation holes in the underside of the pleats, cooling the wearer, whilst water ingress is prevented by the overhang of the overpleat (by the 'tiled-roof' structure), as shown in FIG. 12. The wearer can pull the fabric to stretch the pleats further apart, as shown in FIG. 13, if further ventilation is required.

Figure 14:
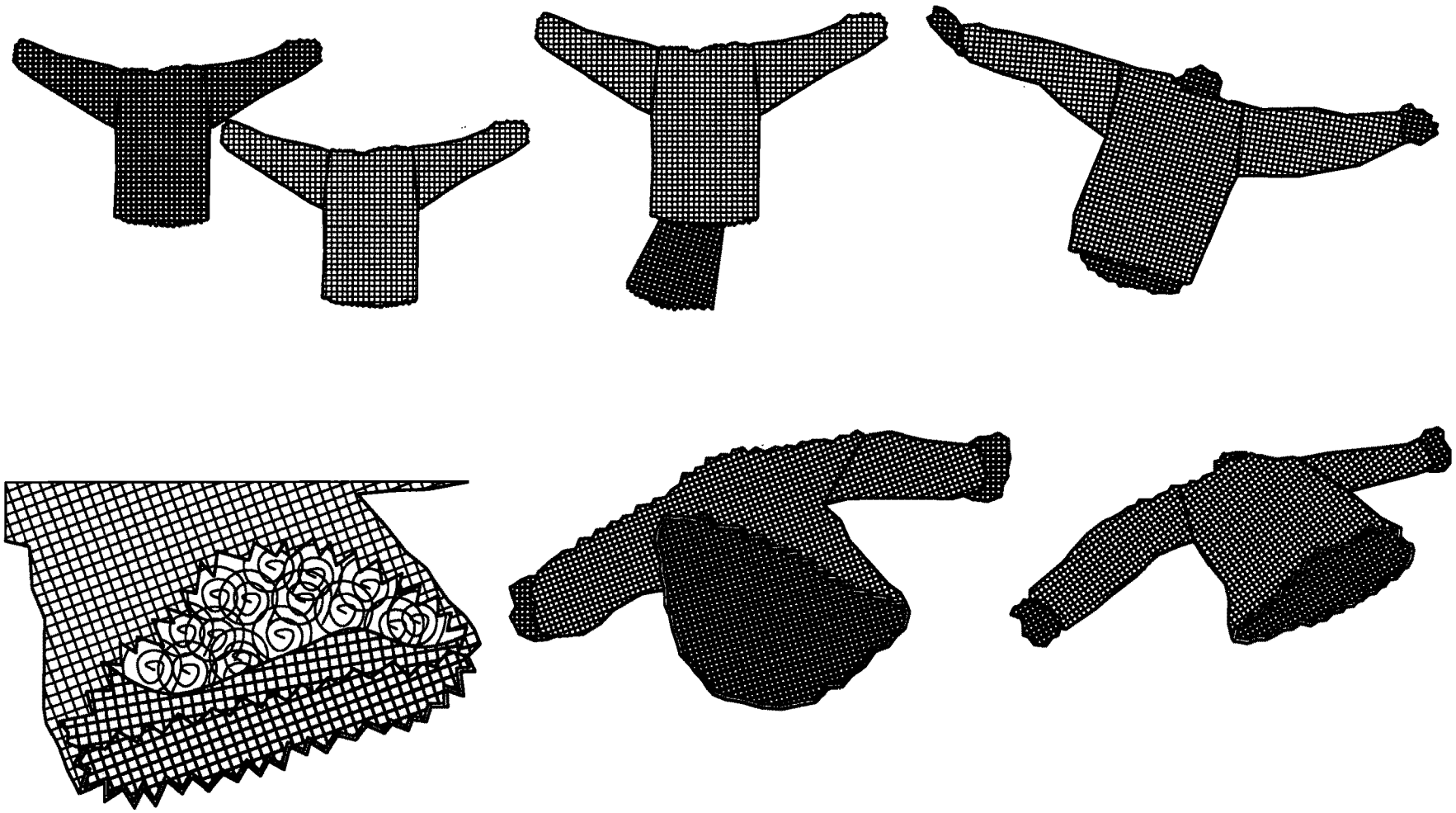
FIG. 14 illustrates six stages included in a process for constructing a double layer pleated garment.

Referring now to FIG. 14, a method of constructing a two layer garment is shown. The two layer garment may be an insulated garment, in that it comprises insulation material such as down or synthetic (e.g. polyester) filling inserted between the layers. The method comprises sewing a fabric into a first garment layer, and pleating the first garment layer in line with the method outlined above. A second fabric is also sewn into a second garment layer of substantially the same size and shape as the first garment layer, so as to provide a lining to the first garment layer, and pleated in line with the method outlined above or in line with an alternative pleating method. The first garment layer and the second garment layer are sewn together at the edges. Insulation is then inserted between the layers, if required. The garment may then be sewn together along one or more seams (e.g. side seams) to assist in holding the garment together and the insulation in place.

The invention has been described above primarily with respect to a garment, but it will be appreciated that expandable fabric described herein could have other uses, e.g. as an expandable structure such as a tent or emergency shelter.

Although the examples described above depict the first and second axes being located vertically and horizontally when the garment is in use, it will be appreciated that the axes can be located differently if desired, depending on implementation. For instance, both axes might be positioned on a diagonal if more growth is required in a diagonal direction. Such an arrangement might be appropriate if the fabric is implemented in an expandable structure rather than a garment.

Similarly, although the axes are described above as being substantially orthogonal, it will be appreciated that other angles are possible. For a garment, we have found that pleating the garment along two orthogonal axes helps the garment to maintain a consistent shape as it expands. There is some tolerance for deviation from 90 degrees, for instance 75-90 degrees, or 80-90 degrees, but preferably the two axes are within 85-90 degrees of each other. For other implementations however, the angle between the axes need not be 90 degrees—it can be selected according to the desired main directions of expansion. In addition, in some circumstances it may be desirable for a garment to grow more in one direction than in another (e.g. maternity wear). The angle between the pleating axes may thus be selected by the user as appropriate to achieve the desired growth.

The invention claimed is:

1. A method of pleating a fabric, the method comprising:

pleating the fabric with a first pleating process to create a first set of pleats in the fabric along a first axis;

pleating the fabric with a second pleating process to create a second set of pleats in the fabric along a second axis different to the first axis, wherein the second set of pleats are pleated over the first set of pleats, and wherein the first set of pleats is a set of flat pleats and the second set of pleats is a set of accordion pleats.

2. The method of claim 1, wherein the first set of pleats and the second set of pleats extend over substantially the entire fabric.

3. The method of claim 1 wherein the second axis is 75-90 degrees to the first axis.

4. The method of claim 1 wherein the second axis is substantially orthogonal to the first axis.

5. The method of claim 1 wherein the flat pleats of the first set of pleats are equally spaced.

6. The method of claim 5, wherein each flat pleat has an overpleat depth of 5-12 mm.

7. The method of claim 1 wherein the accordion pleats of the second set of pleats are equally spaced.

8. The method of claim 7, wherein each accordion pleat has a depth of 5-10 mm.

9. The method of claim 1, wherein the method further comprises the step of forming one or more holes in an underpleat of at least one pleat in the first set of pleats.

10. The method of claim 1, wherein the fabric comprises a garment.

11. The method of claim 10, wherein the first and second pleating processes are applied to the garment.

12. The method of claim 10, wherein the garment comprises sleeves, and wherein, prior to the first pleating process, the method further includes the step of folding the sleeves at an elbow region such that a sleeve axis extends substantially parallel to the first garment axis, with a wrist portion of the sleeve towards a lower edge of the garment.

13. The method of claim 10, wherein the first axis is selected to be substantially vertical when the garment is worn, and the second axis is selected to be substantially horizontal when the garment is worn.

14. The method of claim 1, wherein the fabric is a synthetic fabric or a synthetic/natural fibre blend.

15. A method of constructing a garment, wherein the method comprises sewing a fabric into a first garment layer, and pleating the first garment layer according to the method of claim 1.

16. The method of claim 15, comprising sewing a second fabric into a second garment layer of substantially the same size and shape to the first garment layer, so as to provide a lining to the first garment layer, pleating the second garment layer so the second garment layer is pleated with the same pleat structure as the first garment layer, and sewing the first garment layer to the second garment layer.

17. The method of claim 16, further comprising the step of inserting insulation between the first and second garment layers.

18. A fabric comprising a first set of pleats along a first axis and a second set of pleats along a second axis different to the first axis, wherein the second set of pleats are pleated over the first set of pleats, and wherein the first set of pleats is a set of flat pleats and the second set of pleats is a set of accordion pleats.

19. A garment comprising a first set of pleats along a first axis and a second set of pleats along a second axis different to the first axis, wherein the second set of pleats are pleated over the first set of pleats, wherein the first set of pleats is a set of flat pleats and the second set of pleats is a set of accordion pleats.

20. The fabric of claim 18, wherein the first set of pleats and the second set of pleats extend over substantially the entire fabric.

21. The fabric of claim 18, wherein the second axis is 75-90 degrees to the first axis.

22. The fabric of claim 18, wherein the second axis is substantially orthogonal to the first axis.

23. The fabric of claim 18, wherein the flat pleats of the first set of pleats are equally spaced.

24. The fabric of claim 23, wherein each flat pleat has an overpleat depth of 5-12 mm.

25. The fabric of claim 18, wherein the accordion pleats of the second set of pleats are equally spaced.

26. The fabric of claim 25, wherein each accordion pleat has a depth of 5-10 mm.

27. The fabric of claim 18, wherein at least one pleat in the first set of pleats comprises one or more holes formed in an underpleat.

28. The garment of claim 19, comprising a first garment layer and a second garment layer of substantially the same size and shape to the first garment layer so as to provide a lining to the first garment layer, and insulation between the two layers, wherein each garment layer is pleated with a first pleating process to create a first set of pleats in each garment layer along a first axis and pleated with a second pleating process to create a second set of pleats in each garment layer along a second axis different to the first axis, wherein for each garment layer the second set of pleats are pleated over the first set of pleats, and wherein the first set of pleats is a set of flat pleats and the second set of pleats is a set of accordion pleats.

* * * * *